US008878675B2

(12) United States Patent
Tiedmann

(10) Patent No.: US 8,878,675 B2
(45) Date of Patent: Nov. 4, 2014

(54) MERCHANDISE TAGS WITH REMOVAL DETECTION FOR THEFT PREVENTION

(71) Applicant: Avery Dennison Corporation, Pasadena, CA (US)

(72) Inventor: Heiko Tiedmann, Dachau (DE)

(73) Assignee: Avery Dennison Corporation, Glendale, CA (US)

( * ) Notice: Subject to any disclaimer, the term of this patent is extended or adjusted under 35 U.S.C. 154(b) by 72 days.

(21) Appl. No.: 13/672,137

(22) Filed: Nov. 8, 2012

(65) Prior Publication Data

US 2013/0113627 A1 May 9, 2013

Related U.S. Application Data

(60) Provisional application No. 61/556,861, filed on Nov. 8, 2011.

(51) Int. Cl.
*G08B 13/14* (2006.01)
*G08B 13/24* (2006.01)

(52) U.S. Cl.
CPC ..... *G08B 13/2431* (2013.01); *G08B 13/2448* (2013.01); *G08B 13/2417* (2013.01)
USPC ..... 340/572.1

(58) Field of Classification Search
CPC ..... G08B 13/1418; G08B 13/2434; G08B 13/2402; G08B 13/2448; G08B 13/14; G08B 29/046; G06K 19/07; G06Q 30/0601; G06Q 20/30
USPC ..... 340/572.1–572.9, 10.1, 13.26
See application file for complete search history.

(56) References Cited

U.S. PATENT DOCUMENTS

| | | | | |
|---|---|---|---|---|
| 5,986,562 | A * | 11/1999 | Nikolich | 340/693.5 |
| 2006/0170550 | A1 * | 8/2006 | Marsilio et al. | 340/568.2 |
| 2009/0115615 | A1 | 5/2009 | Bleckmann et al. | |
| 2009/0135014 | A1 * | 5/2009 | Bleckmann et al. | 340/572.8 |
| 2010/0134295 | A1 * | 6/2010 | Lax et al. | 340/572.8 |
| 2012/0019385 | A1 * | 1/2012 | Brodzik et al. | 340/572.9 |

FOREIGN PATENT DOCUMENTS

| | | |
|---|---|---|
| DE | 3732297 | 4/1989 |
| EP | 0692774 | 1/1996 |
| WO | 2011132190 | 10/2011 |

OTHER PUBLICATIONS

International Search Report and Written Opinion dated Feb. 12, 2013 for International Application No. PCT/US2012/064132.

* cited by examiner

*Primary Examiner* — Phung Nguyen
(74) *Attorney, Agent, or Firm* — Avery Dennison Corporation

(57) ABSTRACT

Security tags such as hang tags are provided for mounting on merchandise in a retail setting. The security tags include a substrate, an RFID chip, an antenna, and a protection circuit. The chip is affixed to the substrate, while the antenna and the protection circuit are electrically connected to the chip. The security tag is connected to a piece of merchandise by an attachment element associated with the substrate. The attachment element is configured such that removal of the security tag from a piece of merchandise will damage the protection circuit. The RFID chip is configured to generate a first signal which triggers an alarm if the first signal is received by an RFID reader of a security system. The RFID chip will also trigger an alarm if the protection circuit is damaged by the security tag being removed by a customer in the shopping area or other secure area.

13 Claims, 1 Drawing Sheet

MERCHANDISE TAGS WITH REMOVAL DETECTION FOR THEFT PREVENTION

CROSS-REFERENCE TO RELATED APPLICATIONS

The present application claims the benefit of U.S. Provisional Application No. 61/556,861 filed Nov. 8, 2011, which is incorporated herein by reference in its entirety.

FIELD OF THE INVENTION

The present subject matter relates to merchandise security tags. More particularly, the present subject matter relates to systems and methods for detecting the removal of a security tag, which may be an identification or labeling tag, such as a hang tag or a sewn-in-place tag, from a piece of merchandise.

DESCRIPTION OF RELATED ART

It is known to employ radio frequency identification ("RFID") technology in an area (for example within a store or other retail environment) for various purposes. In one example, an RFID reader is associated with a point-of-sale location or check-out counter of a store and detects a tag associated with an item being purchased to register the price of the item. In another example, an RFID-readable tag or transponder is attached to each piece of merchandise in a store or storage area. The tags are scanned using an RFID reader to keep proper count of the product inventory. In yet another example, RFID technology is used as a security measure.

In a typical RFID-based security system for a store, one or more RFID readers are installed adjacent to an exit, while guard tags are associated with (often by means of a hang tag or label) individual items sold in the store. When a customer purchases an item, the cashier will either remove or otherwise deactivate the guard tag associated therewith. If the guard tag has not been removed or deactivated (for example if a customer attempts to remove the item from the store without paying for it), the RFID reader or readers in the read field will sense the guard tag as the customer is exiting the store. Upon sensing the guard tag, the read field causes an alarm or other alert to trigger, thereby alerting store personnel to possible theft of the item. If, in an effort to avoid detection, the label or tag has been removed by a customer in an attempt to pilfer the associated piece of merchandise, the label or tag will not be read by the RFID reader and the customer may be able to exit the store without paying for the merchandise. Accordingly, it would be advantageous to provide a hang tag or the like which triggers an alarm when it has been removed from the merchandise by a customer while the merchandise remains in the store or otherwise is removed before being moved to a location where detection is to take place.

SUMMARY OF THE INVENTION

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as may be set forth in the claims appended hereto.

In one aspect, a merchandise security tag such as a hang tag or the like comprises a substrate and an RFID chip affixed to the substrate. An antenna and a protection circuit are electrically connected to the RFID chip. An attachment element is associated with the substrate and configured such that removal of the hang tag from a piece of merchandise will damage the protection circuit. The RFID chip is configured to generate a first signal which triggers an alarm if the first signal is received by an RFID reader of a security system. The RFID chip is also configured to generate a second signal if the protection circuit is damaged, thereby triggering an alarm if the second signal is received by an RFID reader of a security system.

In another aspect, a merchandise security tag such as a hang tag or the like comprises a substrate and an RFID chip affixed to the substrate. An antenna and a protection circuit are electrically connected to the RFID chip. An attachment element is associated with the substrate and configured such that removal of the hang tag from a piece of merchandise will damage the protection circuit. The RFID chip is configured to generate a first signal which triggers an alarm if the first signal is received by an RFID reader of a security system. The RFID chip is also configured to generate a second signal unless the protection circuit is damaged, thereby triggering an alarm if the second signal is not received by an RFID reader of a security system.

In yet another aspect, a method is provided for detecting the attempted theft of a piece of merchandise. A merchandise security such as a hang tag or the like is provided, with the hang tag comprising an RFID chip and a protection circuit electrically connected to the RFID chip. The hang tag is connected to a piece of merchandise. If a first signal generated by the RFID chip is received by an RFID reader of a security system, an alarm is triggered. An alarm is also triggered if the protection circuit is damaged.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
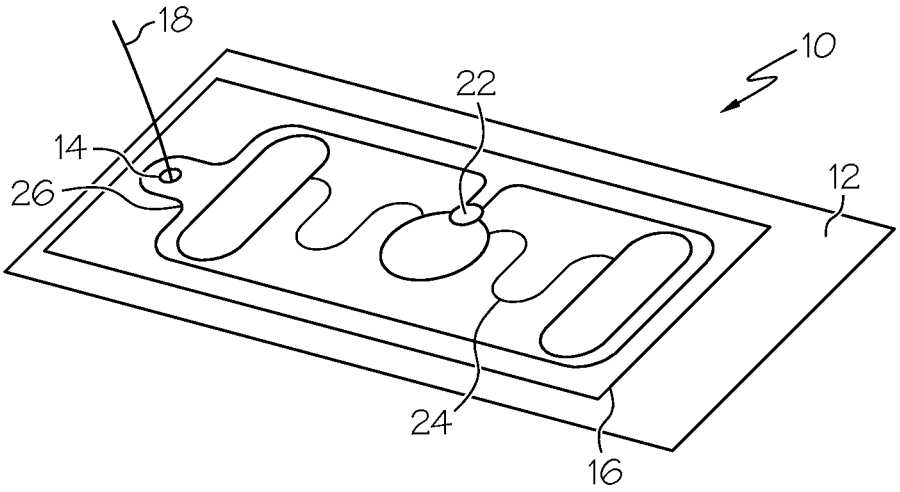
FIG. 1 is a perspective view of a merchandise security tag, in the form of a hang tag, according to aspects of the present disclosure.
Figure 2:
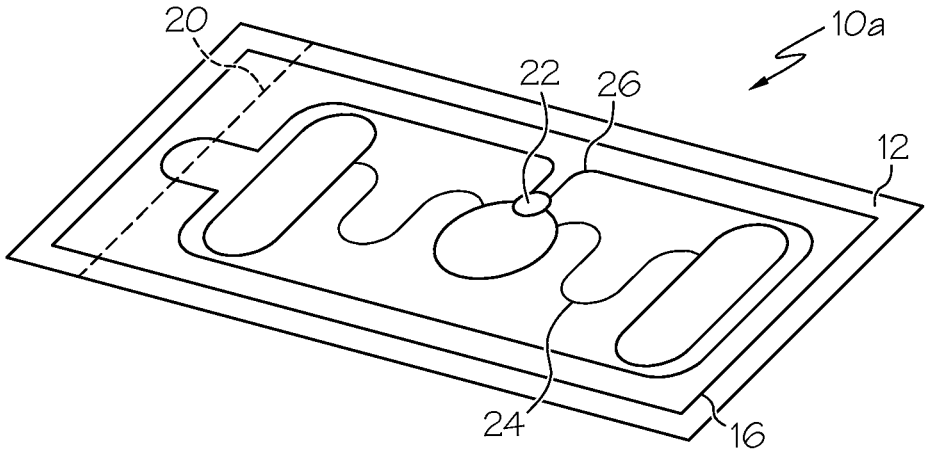
FIG. 2 is a perspective view of an alternative merchandise security tag, in the form of a sewn-in-place tag, according to aspects of the present disclosure.

As security tags are used to prevent theft of merchandise, a thief has an incentive to remove the tag prior to passing through an area monitored by an RFID reader of a security system (typically located at or adjacent to the exit to the store). Illustrative security tags are shown in FIGS. 1 and 2, taking the form of a hang tag 10 and a sew-in-place tag 10*a*.

Such tags may be variously referred to herein as a security tag, a hang tag and/or a merchandise tag. The security tag has features to trigger an alarm when surreptitiously removed by a customer in the store or shopping area.

The security tags 10 and 10*a* differ principally in how they are connected to a piece of merchandise 12 by an attachment element. The hang tag 10 of FIG. 1 includes an opening 14 defined in a substrate or card 16, with a fastener, such as string, wire or tether 18 received by the opening 14 and connected to a portion of the piece of merchandise 12. The sewn-in-place tag 10*a* of FIG. 2 instead includes a sewn-in line 20, which extends along at least a portion of the substrate 16 to fixedly secure that portion of the substrate 16 to the associated piece of merchandise 12. Other attachment means, such as adhesive, may be employed in the security tags without departing from the scope of the present disclosure. That is the security tag may be attached to a consumer item via adhesive, such as a permanent pressure sensitive adhesive.

The security tags 10 and 10*a* include an RFID chip 22 affixed to the substrate 16. The RFID chip 22 may be variously configured, for example, including an integrated circuit for controlling RF communication and other functions of the security tag.

An antenna 24 is electrically connected or coupled to the RFID chip 22. The RFID chip 22 and antenna 24 may be provided on an RFID inlay which can then be applied to a card stock to form the hang tag. RFID inlays, tags and labels are available from Avery Dennison RFID Company, Clinton, SC.

The antenna 24 is adapted to receive energy from an RF field and emit a signal which is transmitted back to one or more external devices, such as the RFID reader of a security system, which receives and analyzes the signal. In one embodiment, the RFID chip 22 is configured to generate at least a first signal and a second signal which are emitted by the antenna 24. The first signal triggers an alarm if it is received by the RFID reader of a security system, functioning according to typical electronic article surveillance principles. That is, the RFID security tag is in a read range of the RFID reader so that the reader can trigger the alarm of the electronic article surveillance device. Thus, if a customer attempts to leave the store without having the security tag properly removed or deactivated by store personnel, the RFID reader of a suitably positioned security system, such as at an exit of the store, will receive the first signal, resulting in an alarm or alert. The second signal is related to an anti-removal feature which triggers an alarm if the security tag is removed by a customer in the shopping area, as will be described in greater detail below.

A protection circuit or anti-tamper loop 26 is also electrically connected to the RFID chip 22. In the illustrated embodiments, the protection circuit 26 is a conductor which substantially encircles the RFID chip 22 and the antenna 24. Other configurations, such as a protection circuit 26 which encircles only the RFID chip 22, only the antenna 24, only a portion of the RFID chip 22, only a portion of the antenna 24, a portion of both the RFID chip 22 and the antenna 24, or neither, may also be employed, individually or together in combinations of two or more such configurations, without departing from the scope of the present disclosure. The protection circuit 26 that is specifically illustrated provides an anti-removal feature by interacting with the RFID chip 22 in one of a number of different possible ways.

For example, in one embodiment, when the protection circuit 26 is intact, it will allow the RFID chip 22 to generate a second signal that is emitted by the antenna 24. The second signal is treated as an "all clear" signal which is received by the RFID reader of a security system monitoring at least a portion of the shopping area. As long as the RFID reader is receiving the second signal (i.e., as long as the protection circuit 26 remains intact), there will be no alarm condition because the security tag, for example hang tag 10 or sewn-in tag 10*a* remains properly attached to the piece of merchandise 12. If the protection circuit 26 is damaged (typically by the security tag being removed from the piece of merchandise 12, as will be described in greater detail below), the RFID chip 22 will be unable to generate the second signal. In the absence of the expected second signal, the RFID reader of the security system will trigger an alarm, which is indicative of the security tag having been improperly removed by a customer in the zone monitored by the RFID reader (e.g., in a changing room).

In an alternative version of the preceding embodiment, damaging the protection circuit 26 causes the RFID chip 22 to generate a third signal instead of the expected second signal. The third signal is treated as a "tampering" or "alert" signal by the RFID reader of a security system monitoring the shopping area. When the RFID reader of the security system receives the third signal it will trigger an alarm, which is indicative of the security tag having been improperly removed by a customer in the zone monitored by the RFID reader.

In yet another embodiment, when the protection circuit 26 is intact it will prevent the RFID chip 22 from generating a second signal. In the absence of the second signal, there will be no alarm condition because the security tag remains properly attached to the piece of merchandise. If the protection circuit 26 is damaged (e.g., by the security tag having been removed from the piece of merchandise 12), it will allow the RFID chip 22 to generate a second signal. The second signal is treated as a "tampering" or "alert" signal by the RFID reader of a security system monitoring the shopping area. When the RFID reader of the security system receives the second signal it will trigger an alarm, which is indicative of the security tag having been improperly removed by a customer in the zone monitored by the RFID reader.

As an example, the most common way to remove a hang tag or a security tag or label is to grip it and abruptly pull in a direction away from the attachment element. Preferably, the attachment element is positioned and oriented such that removing the security tag from the associated piece of merchandise 12 will cause the attachment element to damage the protection circuit 26. For example, in the embodiment of FIG. 1, the protection circuit 26 substantially encircles the opening 14 and fastener 18. When the hang tag 10 is pulled free of the fastener 18 by a customer, the fastener 18 will rip through the substrate 16 and the protection circuit 26, thereby damaging the protection circuit 26. In the embodiment of FIG. 2, the sewn-in line 20 intersects the protection circuit 26 and, when the sewn-in-place tag 10*a* is pulled free of the piece of merchandise 12, the sewn-in line 20 will remain at least partially secured to the piece of merchandise 12 and rip through the substrate 16 and the protection circuit 26.

Damaging the protection circuit 26 while in a monitored shopping area leads to an alarm (as generally described above). It will be appreciated that, by properly positioning and orienting the attachment element, tampering with or removing the hang tag 10 and/or the sewn-in-place tag 10*a* inside of the store or secure area will trigger an alarm.

The protection circuit 26 as can be seen from the figures extends substantially peripherally around RFID antenna 24 to substantially enclose the RFID antenna 24 on the substrate to which it has been applied. Which the figures illustrate an inverted "U" shape extending above a sever line it should be understood that circuit 26 may include any other shape such that at least a portion of the circuit 26 extends over the cover line.

While the substrate on which the circuit and antenna are provided is shown in a generally rectangular or quadrate shape, other configurations are of course possible, such as those that might be used to highlight a brand or feature of the article to which it is attached.

The security tag of the present invention while shown with the security circuit exposed may be covered with a blank of material such as to form an enclosed label or hang tag. The security circuit may be inserted into another pocket or envelope or the security circuit may be exposed so that a would be thief can readily see the device is present and thereby provide a visual deterrent. The hang tag of the present invention may be provided with indicia such as that identifying a brand owner or other printed information such as pricing and care instructions for the article to which it is attached.

In another embodiment, severing of the circuit 26 will still allow the RFID circuit to function such that if a legitimate purchase is made, the RFID device can be returned to inventor when a inventory clerk scans or reads the information encoded on the chip.

Other embodiments, besides those illustrated in FIGS. 1 and 2, may also be employed without departing from the scope of the present disclosure. For example, other means for attaching the security tag to a piece of merchandise may be used in combination with a protection circuit. Further, other configurations of the protection circuit may be employed, as well as embodiments employing more than one protection circuit associated with a single security tag, hang tag or sewn-in-place tag.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

What is claimed is:

1. A merchandise security tag comprising:

a substrate;

an RFID chip affixed to the substrate;

an antenna electrically connected to the RFID chip;

a protection circuit electrically connected to the RFID chip; and an attachment element associated with the substrate and configured such that removal of the security tag from a piece of merchandise will damage the protection circuit such that the attachment element comprises an opening defined in the substrate and a fastener received by the opening and the protection circuit substantially encircles the opening, wherein the RFID chip is configured to:

(i) generate a first signal which triggers an alarm if the first signal is received by an RFID reader of a security system, and (ii) generate a second signal if the protection circuit is damaged, thereby triggering an alarm if the second signal is received by an RFID reader of a security system.

2. The merchandise security tag of claim 1, wherein the attachment element comprises a sewn-in line.

3. The merchandise security tag of claim 2, wherein the sewn-in line intersects the protection circuit.

4. A merchandise security tag comprising:

a substrate;

an RFID chip affixed to the substrate;

an antenna electrically connected to the RFID chip;

a protection circuit electrically connected to the RFID chip; and an attachment element associated with the substrate and configured such that removal of the security tag from a piece of merchandise will damage the protection circuit such that the attachment element comprises a sewn-in line and the sewn-in line intersects the protection circuit, wherein the RFID chip is configured to:

(i) generate a first signal which triggers an alarm if the first signal is received by an RFID reader of a security system, and (ii) generate a second signal unless the protection circuit is damaged, thereby triggering an alarm if the second signal is not received by an RFID reader of a security system.

5. The merchandise security tag of claim 4, wherein the protection circuit substantially encircles the RFID chip.

6. The merchandise security tag of claim 4, wherein the protection circuit substantially encircles the antenna.

7. The merchandise security tag of claim 4, wherein the protection circuit substantially encircles the RFID chip and the antenna.

8. The merchandise security tag of claim 4, wherein the attachment element comprises an opening defined in the substrate and a fastener received by the opening.

9. The merchandise security tag of claim 8, wherein the protection circuit substantially encircles the opening.

10. A method of detecting the attempted theft of a piece of merchandise, comprising:

providing a merchandise security tag comprising an RFID chip, an attachment element having a sewn in line, and a protection circuit electrically connected to the RFID chip such that the sewn in line intersects the protection circuit;

connecting the merchandise security tag to a piece of merchandise;

triggering an alarm if a first signal generated by the RFID chip is received by an RFID reader of a security system; and triggering an alarm if the protection circuit is damaged.

11. The method of claim 10, wherein said triggering an alarm if the protection circuit is damaged includes an RFID reader of a security system receiving a second signal generated by the RFID chip.

12. The method of claim 10, wherein said triggering an alarm if the protection circuit is damaged includes an RFID reader of a security system failing to receive an expected second signal generated by the RFID chip.

13. The method of claim 12, wherein said triggering an alarm if the protection circuit is damaged includes an RFID reader of a security system receiving a third signal generated by the RFID chip instead of receiving an expected second signal generated by the RFID chip.

* * * * *